US008960808B2

(12) United States Patent
Wakita et al.

(10) Patent No.: US 8,960,808 B2
(45) Date of Patent: Feb. 24, 2015

(54) UNDERWATER MINER CUTTER HEAD, UNDERWATER MINER, AND UNDERWATER MINING SYSTEM

(75) Inventors: Norihide Wakita, Tokyo (JP); Futoshi Sameshima, Tokyo (JP); Hiroyuki Odaka, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 52 days.

(21) Appl. No.: 13/635,492

(22) PCT Filed: May 9, 2011

(86) PCT No.: PCT/JP2011/060664

§ 371 (c)(1), (2), (4) Date: Oct. 23, 2012

(87) PCT Pub. No.: WO2011/142319

PCT Pub. Date: Nov. 17, 2011

(65) Prior Publication Data

US 2013/0038113 A1 Feb. 14, 2013

(30) Foreign Application Priority Data

May 10, 2010 (JP) ..... 2010-108314

(51) Int. Cl.

| | |
|---|---|
| ***E02F 3/92*** | (2006.01) |
| ***E02F 3/24*** | (2006.01) |
| ***E02F 3/88*** | (2006.01) |
| ***E02F 3/20*** | (2006.01) |
| *E21C 50/00* | (2006.01) |

(52) U.S. Cl.

CPC ..... *E02F 3/246* (2013.01); *E02F 3/9268* (2013.01); *E02F 3/8866* (2013.01); *E21C 50/00* (2013.01); *E02F 3/205* (2013.01); *E02F 3/9237* (2013.01)

USPC ..... 299/39.4; 299/41.1; 299/9

(58) Field of Classification Search

CPC ..... E02F 3/8875; E02F 3/9268; E02F 3/9281

USPC ..... 299/8, 9, 39.4, 39.9, 41.1; 37/307, 313, 37/317, 324, 326, 329, 330, 331, 327, 328, 37/342, 343

See application file for complete search history.

(56) References Cited

U.S. PATENT DOCUMENTS

| | | | | |
|---|---|---|---|---|
| 5,148,615 | A * | 9/1992 | Maitlen et al. | 37/329 |
| 2005/0127741 | A1* | 6/2005 | Davey et al. | 299/39.9 |

FOREIGN PATENT DOCUMENTS

| | | | |
|---|---|---|---|
| GB | 1383089 | A * | 2/1975 |
| JP | 2-58083 | | 4/1990 |

(Continued)

OTHER PUBLICATIONS

International Search Report issued Jul. 12, 2011 in corresponding International Application No. PCT/JP2011/060664.

*Primary Examiner* — David Bagnell
*Assistant Examiner* — Michael Goodwin
(74) *Attorney, Agent, or Firm* — Wenderoth, Lind & Ponack, LLP

(57) ABSTRACT

Provided is an underwater miner cutter head (20) attached to an underwater miner disposed on a seabed and configured to excavate the seabed, the cutter head including cylindrical cutter drums (21) disposed on respective sides defining a regular polygon in plan view, having bits (26) on the outer circumferential surfaces thereof, and configured to rotate around corresponding first rotational axes by first driving sources; and an intake (28) disposed at a center part of the regular polygon and configured to receive muck excavated with the bits (26), wherein rotating directions of the cutter drums (21) are set such that the bits (26) sequentially move toward the intake (28).

3 Claims, 3 Drawing Sheets

(56) References Cited

FOREIGN PATENT DOCUMENTS

| | | | | |
|---|---|---|---|---|
| JP | 2-58091 | 4/1990 | | |
| JP | 03180627 A | * | 8/1991 | |
| JP | 10-212734 | | 8/1998 | |
| JP | 2010-13900 | | 1/2010 | |

* cited by examiner

UNDERWATER MINER CUTTER HEAD, UNDERWATER MINER, AND UNDERWATER MINING SYSTEM

TECHNICAL FIELD

The present invention relates to, for example, an underwater miner cutter head for excavating seabed mineral deposits and attached to the tip of a boom of a miner (mining machine) that is a component of an underwater mining system for mining seabed mineral deposits.

BACKGROUND ART

For example, an unmanned untethered underwater excavator disclosed in PTL 1 is a known excavator (miner: mining machine) for excavating the seafloor.

CITATION LIST

Patent Literature

{PTL 1} Japanese Unexamined Patent Application, Publication No. HEI-10-212734

SUMMARY OF INVENTION

Technical Problem

However, a cutter head disposed at the tip of a ladder (boom) 14 of an unmanned untethered underwater excavator 10 disclosed in PTL 1 is a double drum cutter 11, and excavated muck rolls downward off of it (onto the seafloor). Thus, the invention disclosed in PTL 1 requires an underwater mucking machine 30 that collects the excavated muck that has fallen onto the seafloor and thus is unsuitable for (incapable of) mining seabed mineral deposits.

In the double drum cutter 11, an excavation reaction force is cancelled out in one direction (horizontal direction) but remains in the other direction (vertical direction). The reaction force in the other direction acts upon the excavator as a force causing the excavator to move; thus, an excavator including the double drum cutter 11 must have a large crawler and outrigger that support the reaction force in the other direction, causing a problem of an increase in size of the excavator itself.

The double drum cutter 11 also has a problem in that an unexcavated region remains between one drum cutter and the other drum cutter, resulting in unsatisfactory excavation efficiency.

The present invention has been conceived in light of the above-described circumstances, and an object thereof is to provide an underwater miner cutter head that can cancel out the reaction forces in the horizontal and vertical directions to improve the excavation efficiency.

Solution to Problem

The present invention employs the following solutions to solve the above-described problems.

An underwater miner cutter head according to the present invention is attached to an underwater miner disposed on a seabed and is configured to excavate the seabed, the cutter head including cylindrical cutter drums disposed on respective sides defining a regular polygon in plan view, having bits disposed on the outer circumferential surfaces thereof, and configured to rotate around corresponding first rotational axes by first driving sources; and an intake disposed at a center part of the regular polygon and configured to receive muck excavated with the bits, wherein the rotating directions of the cutter drums are set such that the bits sequentially move toward the intake.

In the underwater miner cutter head according to the present invention, the muck excavated with the bits is sequentially transported to the intake and collected; thus, a device such as an underwater mucking machine that collects the excavated muck that has fallen to the seafloor is not required.

Since the cutter drums are disposed on the sides defining a regular polygon (e.g., square) in plan view, the reaction forces in the horizontal and vertical directions are cancelled out.

With the underwater miner cutter head, it is more preferable that the cutter drums be attached via a cutter support arm, and a plate-like turning base rotated by a second driving source around a second rotational axis passing through the center of a regular polygon is provided.

With such an underwater miner cutter head, since the cutter drums rotate together with the turning base around the second rotational axis passing through the center of a regular polygon, unexcavated areas remaining between adjacent cutter drums are eliminated, improving the excavation efficiency.

It is more preferable that the underwater miner cutter head include a third driving source configured to slide the turning base in a direction orthogonal to the second rotational axis.

With such an underwater miner cutter head, since the cutter drums slide together with the turning base in a direction orthogonal to the second rotational axis, unexcavated areas remaining between opposing cutter drums are eliminated, further improving the excavation efficiency.

The underwater miner according to the present invention includes one of the above-described underwater miner cutter heads.

With such an underwater miner according to the present invention, since the reaction forces in the horizontal and vertical directions generated during excavation are cancelled out, an increase in size of the crawler and outrigger can be avoided, and thus, an increase in size of the underwater miner itself can be avoided.

The underwater mining system according to the present invention includes the above-described underwater miner.

With the underwater mining system according to the present invention, a device such as an underwater mucking machine that collects the excavated muck that has fallen to the seafloor is not required, achieving a decrease in size of the underwater miner itself. Thus, the entire underwater mining system can be simplified, and the manufacturing cost can be reduced.

Advantageous Effects of Invention

The underwater miner cutter head according to the present invention is advantageous in that the reaction forces in the horizontal and vertical directions can be cancelled out, improving the excavation efficiency.

BRIEF DESCRIPTION OF DRAWINGS

FIG. 1 is a perspective bottom view of an underwater miner cutter head according to an embodiment of the present invention.

FIG. 2 is a sectional side view of the underwater miner cutter head according to an embodiment of the present invention.

FIG. 3 is a bottom plan view of the underwater miner cutter head according to an embodiment of the present invention.

FIG. 4 is a conceptual configuration diagram illustrating a specific example of an underwater mining system including, as a component, an underwater miner having an underwater miner cutter head according to an embodiment of the present invention.

DESCRIPTION OF EMBODIMENTS

Figure 1:
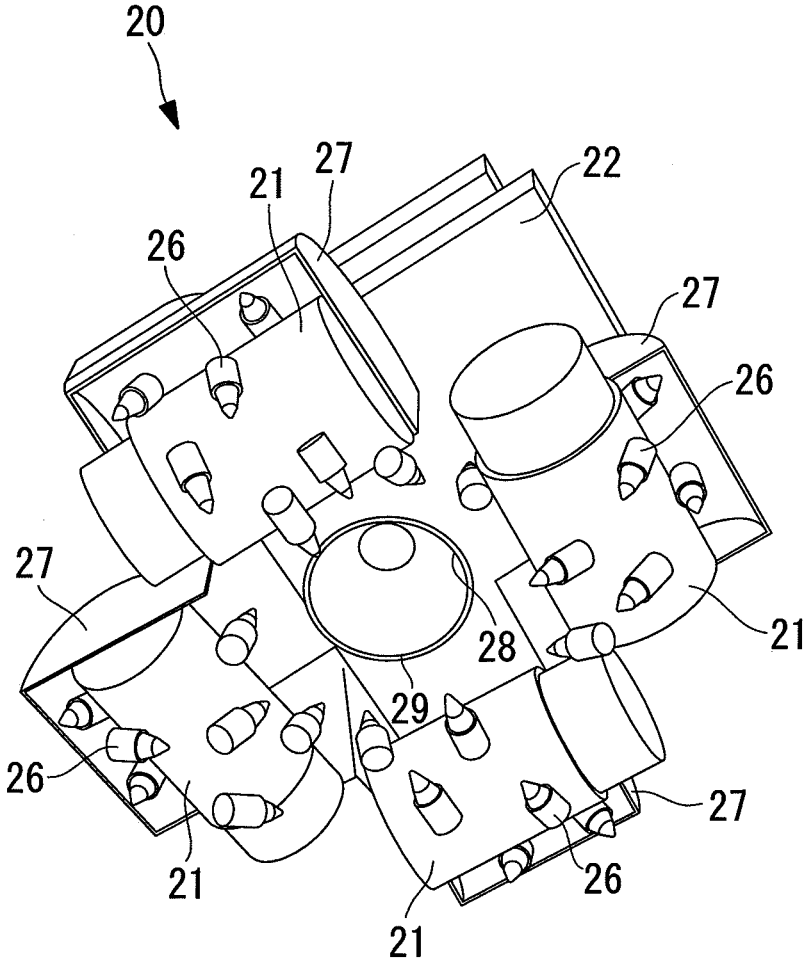
{FIG. 1}
Figure 2:
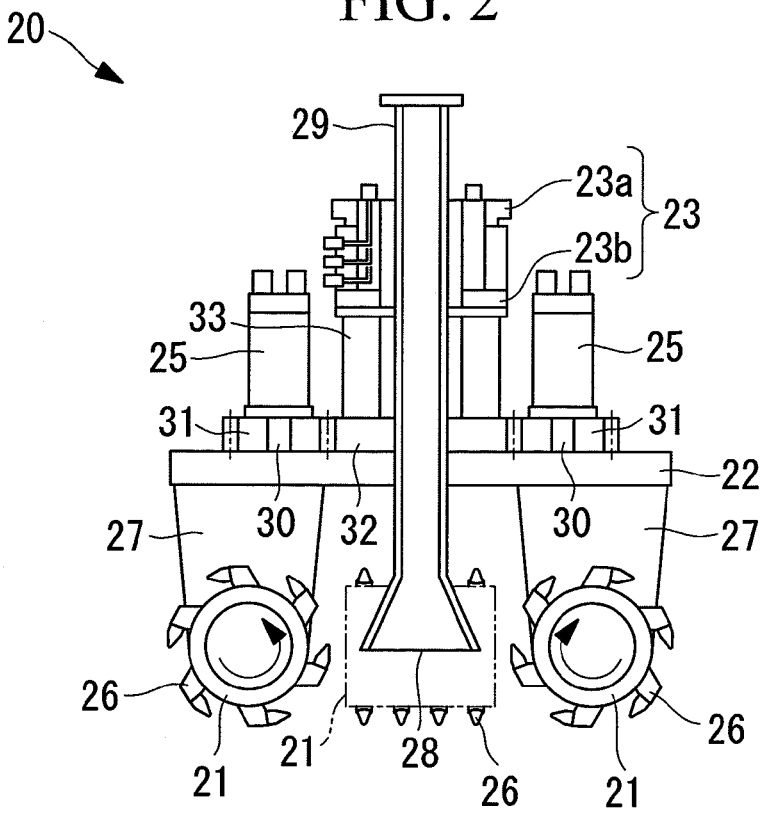
{FIG. 2}
Figure 3:
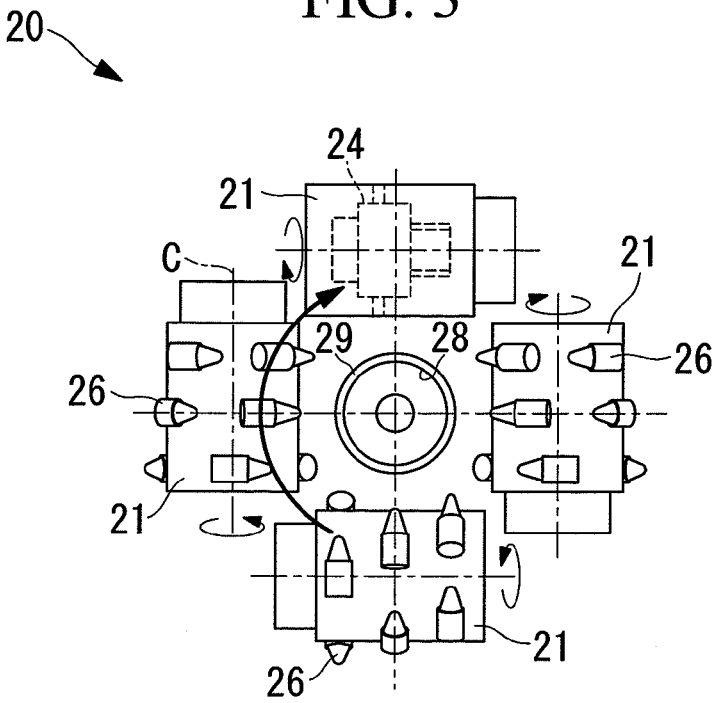
{FIG. 3}
Figure 4:
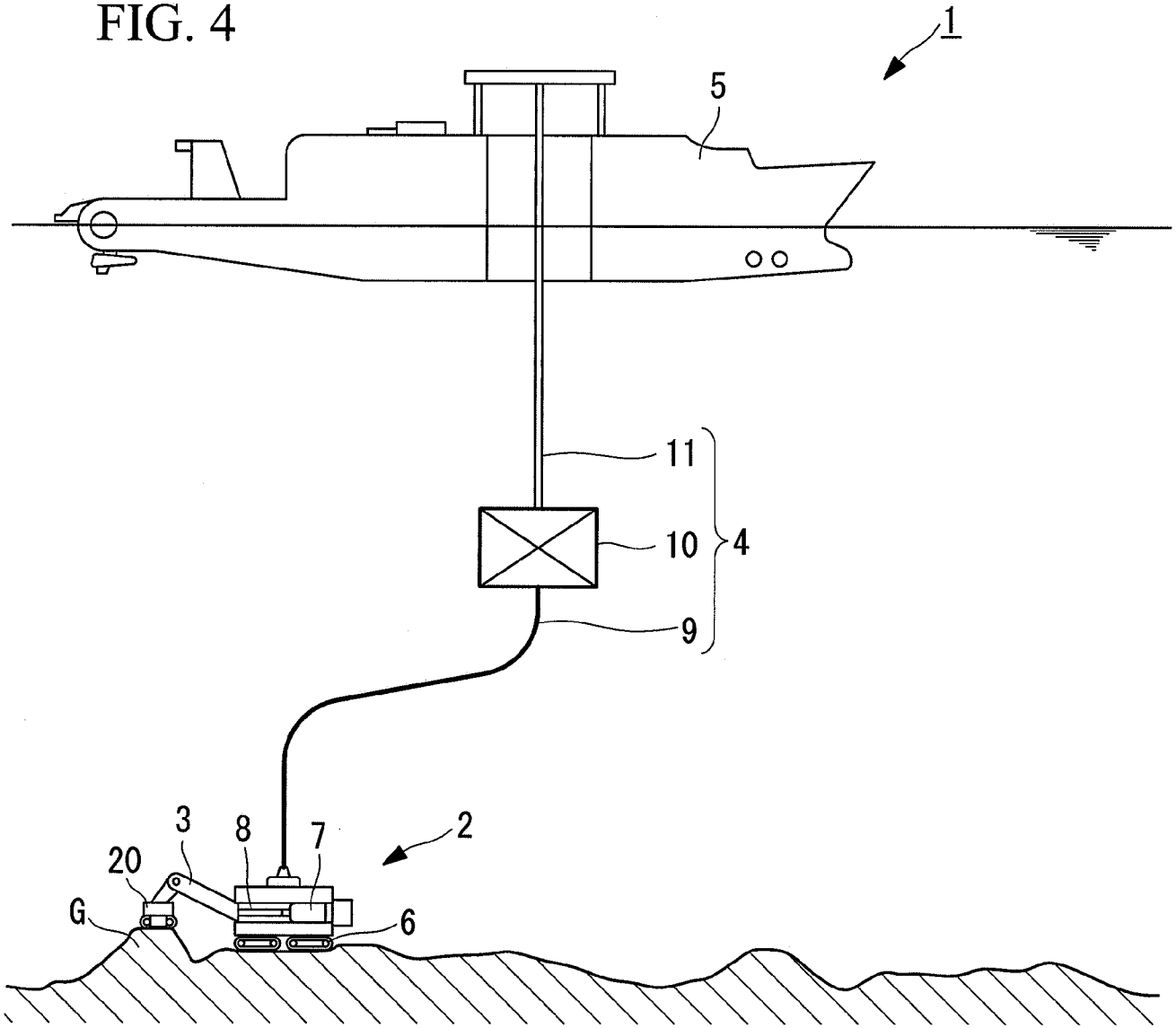
{FIG. 4}

An underwater miner cutter head according to an embodiment of the present invention will now be described with reference to FIGS. 1 to 4. FIG. 1 is a perspective bottom view of the underwater miner cutter head according to this embodiment. FIG. 2 is a sectional side view of the underwater miner cutter head according to this embodiment. FIG. 3 is a bottom plan view of the underwater miner cutter head according to this embodiment. FIG. 4 is a conceptual configuration diagram illustrating a specific example of an underwater mining system including, as a component, an underwater miner having an underwater miner cutter head according to this embodiment.

An underwater miner cutter head (hereinafter, simply referred to as "cutter head") 20 according to this embodiment is attached to, for example, the tip of a boom 3 of an underwater miner (underwater mining machine) 2, which is a component of an underwater mining system 1 for mining a seabed mineral deposit G, such as that illustrated in FIG. 4, and is used for excavating the seabed mineral deposit G.

The underwater mining system 1 includes the underwater miner (hereinafter, simply referred to as "miner") 2, a lifting device 4, and a mining mothership 5.

The miner 2 includes a cutter head 20, a boom 3, a moving device 6 having a crawler, a slurry pump 7, and a flexible suction pipe 8. The seabed mineral deposit G excavated by the cutter head 20 is sucked into the slurry pump 7 through the suction pipe 8 together with seawater and is pneumatically pumped (delivered) as slurry through a slurry hose 9, which is described below.

The suction pipe 8 is disposed inside the boom 3 and the main body of the miner 2; one end thereof is connected to suction port of the cutter head 20 described below, and the other end is connected to a suction port of the slurry pump 7.

The lifting device 4 includes the flexible slurry hose 9, an underwater pump unit (subsea pump unit) 10 including a high-pressure underwater pump (not shown), and a lifting pipe 11. The slurry lifted to the underwater pump unit 10 through the slurry pump 7 and the slurry hose 9 is pneumatically pumped (delivered) through the lifting pipe 11 by the high-pressure underwater pump constituting the underwater pump unit 10.

The mining mothership 5 holds a slurry processing system (not shown); the slurry lifted to the mining mothership 5 through the underwater pump unit 10 and the lifting pipe 11 is separated by the slurry processing system into the seabed mineral deposit G and unwanted matter. Then, the seabed mineral deposit G is collected and the unwanted matter is discarded into the ocean.

As shown in at least one of FIGS. 1 to 3, the cutter head 20 includes four cutter drums 21, a turning base 22, a hydraulic (rotary) swivel 23, hydraulic motors 24 for the corresponding cutter drums (first driving sources), and hydraulic motors (second driving sources) 25 for a (first) turning base.

The cutter drums 21 are cylindrical members that are made to spin around corresponding (first) rotational axes (center axes) C by the corresponding hydraulic motors 24 for the cutter drums. A plurality of (twelve in this embodiment) bits 26 are spirally arranged on the outer circumferential surface of each cutter drum 21. The cutter drums 21 are disposed such that the rotational axes C thereof are positioned on sides defining a square in plan view and are attached to the turning base 22 via cutter support arms 27. The bits 26 are disposed on outer circumferential surfaces of the cutter drums 21 facing each other in line symmetry such that the spiral (alignment) directions of the bits 26 are opposite, i.e., such that the line-symmetrically arranged bits 26 are presented sequentially as the cutter drums 21 that face each other in line symmetry (disposed on opposing sides) rotate.

A discharge pipe 29 having an intake 28 at one end (lower end in FIG. 2) passes through the center part of the turning base 22; and a large (flat) gear 32 engaged with small (flat) gears 31, which are secured to rotary shafts 30 of the hydraulic motors 25 for the turning base, is disposed on the center part.

The large gear 32 is secured to the upper surface of the turning base 22 such that the turning base 22 and the large gear 32 rotate (revolve) around the discharge pipe 29.

The hydraulic swivel 23 includes a fixed portion 23*a* and a rotating portion 23*b*. The fixed portion 23*a* is secured to the discharge pipe 29 with a frame (support member), which is not shown, and the rotating portion 23*b* is secured to the large gear 32 with a pipe frame 33. The rotating portion 23*b* of the hydraulic swivel 23 and the pipe frame 33 can rotate (revolve) around the discharge pipe 29 together with the turning base 22 and the large gear 32.

The hydraulic motors 24 for the cutter drums are hydraulic motors that rotate (spin) the cutter drums 21 around the rotational axes C by using hydraulic fluid supplied from the miner 2 through the hydraulic swivel 23. The hydraulic motors 24 for the cutter drums are accommodated in the corresponding cutter drums 21. The rotating directions of the hydraulic motors 24 for the cutter drums are set such that the seabed mineral deposit G excavated with the bits 26 flows to the intake 28, i.e., such that the bits 26 disposed on the outer circumferential surfaces of the cutter drums 21 sequentially move toward the intake 28. In other words, the rotating directions of the hydraulic motors 24 for the cutter drums are set such that the line-symmetrically arranged bits 26, as viewed from below, sequentially move from the outer side to the inner side as the cutter drums 21 disposed on opposing sides rotate.

The hydraulic motors 25 for the turning base are hydraulic motors that rotate (revolve) the turning base 22 around a center axis (longitudinal axis: second rotational axis) of the discharge pipe 29 with the hydraulic fluid supplied from the miner 2 through the hydraulic swivel 23. The hydraulic motors 25 for the turning base are vertically disposed on the upper surface of the turning base 22 (in this embodiment, two hydraulic motors 25 are disposed on the upper surface of the turning base 22 so as to face each other). The small gears 31 engaged with the above-described large gear 32 are secured to the rotary shafts 30 of the hydraulic motors 25 for the turning base. The small gears 31 rotating in one direction (the direction indicated by a thick solid arrow in FIG. 3) cause the cutter drums 21, the cutter support arms 27, the turning base 22, the large gear 32, the pipe frame 33, and the rotating portion 23*b* of the hydraulic swivel 23 to rotate in the one direction. The small gears 31 rotating in the other direction cause the cutter drums 21, the cutter support arms 27, the turning base 22, the large gear 32, the pipe frame 33, and the rotating portion 23*b* of the hydraulic swivel 23 to rotate in the other direction.

The hydraulic motors 25 for the turning base are secured to the above-described frame (support member) and do not rotate (revolve) in the same manner as the discharge pipe 29 and the fixed portion 23*a* of the hydraulic swivel 23.

With the cutter head 20 according to this embodiment, muck excavated with the bits 26 is sequentially transported to the intake 28 and is collected. Accordingly, it is possible to provide an underwater mining system that does not require a device such as an underwater mucking machine that collects the excavated muck that has fallen to the seafloor.

Since the cutter drums 21 are disposed on the sides defining a square in plan view, the reaction forces in the horizontal and vertical directions are cancelled out.

The cutter drums 21 rotate, together with the turning base 22, around the center axis of the discharge pipe 29 (second rotational axis passing through the center of a regular polygon). Thus, unexcavated areas between adjacent cutter drums 21 can be eliminated, improving the excavation efficiency.

The present invention is not limited to the embodiment described above, and various modifications may be made without departing from the scope of the invention.

For example, a hydraulic motor (third driving source) for a (second) turning base is preferably included to slide the turning base 22 in a direction orthogonal to the center axis of the discharge pipe 29.

In such a cutter head, the cutter drums 21 can slide, together with the turning base 22, in a direction orthogonal to the center axis of the discharge pipe 29. Thus, unexcavated areas between opposing cutter drums 21 can be eliminated, further improving the excavation efficiency.

REFERENCE SIGNS LIST

1 underwater mining system
2 (underwater) miner
20 (underwater miner) cutter head
21 cutter drum
22 turning base
24 hydraulic motor (first driving source) for cutter drum
25 hydraulic motor (second driving source) for (first) turning base
26 bit
27 cutter support arm
28 intake
C (first) rotational axis

The invention claimed is:

1. An underwater miner cutter head attached to an underwater miner disposed on a seabed and configured to excavate the seabed, the cutter head comprising:

cylindrical cutter drums disposed on respective sides defining a regular polygon in plan view, having bits provided on outer circumferential surfaces thereof, and configured to rotate around corresponding first rotational axes by first driving sources;

an intake disposed at a center part of the regular polygon and configured to receive muck excavated with the bits, wherein rotating directions of the cutter drums are set such that the bits move toward the intake; and a plate-like turning base to which the cutter drums are attached via a cutter support arm and which is rotated by a second driving source around a second rotational axis passing through the center of the regular polygon.

2. An underwater miner comprising: The underwater miner cutter head according to claim 1.

3. An underwater mining system comprising:

the underwater miner according to claim 2.

* * * * *